US008424867B2

(12) United States Patent
Morisaki

(10) Patent No.: US 8,424,867 B2
(45) Date of Patent: Apr. 23, 2013

(54) SHEET FEEDER AND IMAGE FORMING APPARATUS INCLUDING THE SAME

(75) Inventor: Ryohei Morisaki, Aichi (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 13/137,945

(22) Filed: Sep. 22, 2011

(65) Prior Publication Data

US 2012/0080836 A1 Apr. 5, 2012

(30) Foreign Application Priority Data

Oct. 5, 2010 (JP) ..... 2010-225843

(51) Int. Cl.
*B65H 3/52* (2006.01)

(52) U.S. Cl.
USPC ..... 271/121; 271/117; 271/118

(58) Field of Classification Search ..... 271/121, 271/117, 118, 167
See application file for complete search history.

(56) References Cited

U.S. PATENT DOCUMENTS

| | | | | |
|---|---|---|---|---|
| 5,344,134 | A | 9/1994 | Saeki et al. | |
| 6,331,001 | B1 * | 12/2001 | Sekiguchi | 271/9.01 |
| 6,565,077 | B2 * | 5/2003 | Kawada | 271/10.03 |
| 7,401,774 | B2 * | 7/2008 | Ginzton | 271/124 |
| 7,481,419 | B2 * | 1/2009 | Kim | 271/9.01 |
| 7,850,169 | B2 | 12/2010 | Minami | |
| 7,963,519 | B2 * | 6/2011 | Bokelman et al. | 271/117 |
| 8,167,299 | B2 * | 5/2012 | Shirasaki | 271/125 |
| 8,240,657 | B2 * | 8/2012 | Tanaka et al. | 271/121 |
| 2006/0180989 | A1 * | 8/2006 | Seike et al. | 271/121 |
| 2007/0029720 | A1 | 2/2007 | Minami | |
| 2007/0108696 | A1 * | 5/2007 | Yorimoto | 271/121 |

FOREIGN PATENT DOCUMENTS

| | | | |
|---|---|---|---|
| JP | 05-278884 | A | 10/1993 |
| JP | 06-144619 | A | 5/1994 |
| JP | 2007-137559 | A | 6/2007 |
| JP | 4195680 | B2 | 10/2008 |

OTHER PUBLICATIONS

English language abstract for JP-2005-343582 which corresponds to JP-4195680-B2.

* cited by examiner

*Primary Examiner* — Kaitlin Joerger
(74) *Attorney, Agent, or Firm* — Harness, Dickey & Pierce P.L.C.

(57) ABSTRACT

A sheet feeder includes: a friction pad held by a pad holder; and a separation roller that is in contact with the friction pad while in rotation. A separation nip formed between the friction pad and the separation roller separates a recording medium from a plurality of recording media fed into the separation nip, and the pad holder includes a convex portion that is provided downstream of the friction pad in a sheet feeding direction and at a middle portion in a first width direction perpendicular to the sheet feeding direction and that is capable of coming into contact with the recording medium.

7 Claims, 8 Drawing Sheets

SHEET FEEDER AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2010-225843 filed in Japan on Oct. 5, 2010.

BACKGROUND OF THE INVENTION

1. Field of the Invention

The present invention relates to a sheet feeder employed in an image forming apparatus such as a printer, a copying machine, and a facsimile and particularly relates to a sheet feeder feeding a stack of a plurality of recording media by separating the stacked media one by one.

2. Description of the Related Art

A friction pad separation type sheet feeder has been used in image forming apparatus such as a printer, a copying machine, and a facsimile as a mechanism for feeding stacked recording media or originals by separating each piece at a time. The friction pad separation type sheet feeder feeds recording media by separating the media one by one by a separation nip formed between a paper feeding roller and the friction pad provided to face the paper feeding roller.

In the friction pad separation type sheet feeder, a recording medium passes over the friction pad while being separated to be fed. During the process, a recording medium having a larger width than the friction pad is bent across the width direction to have a convex shape, and both edges of the medium in the width direction droop. When the recording medium passes over the friction pad with both edges drooping, the edges of the recording medium in the width direction will be caught on the edges of the friction pad to cause feeding failure. Moreover, when the recording medium has a bur produced during cutting, the bur digs into one of the ends of the friction pad to cause feeding failure.

To prevent the feeding failure described above, for example, Japanese Patent Application Laid-open No. 06-144619 discloses a sheet feeder in which a recording medium is prevented from being caught on in the following manner. A guiding plate having a low coefficient of friction covers the leading end of the front surface portion of a holder holding a friction pad on a paper feeding side and both edges of the paper feeding surface of the friction pad in the width direction. Japanese Patent Application Laid-open No. 05-278884 also discloses a sheet feeder in which a bur of a recording medium is prevented from digging in an edge of a friction pad by installing a guiding member at both edges of the friction pad and guiding the leading end of the recording medium with the top surface of the guiding member.

Moreover, in the friction pad separation type sheet feeder, the leading end of a recording medium to be fed comes into contact with a friction pad before reaching a separation nip, causing drawback and failing to properly feed the recording medium.

A sheet feeder for dealing with the drawbacks is also disclosed in that a low friction sheet is provided in front of the separation nip formed partly by a friction pad to prevent the friction pad from wearing and to properly feed originals.

However, the sheet feeders disclosed in Japanese Patent Application Laid-open No. 06-144619 and Japanese Patent Application Laid-open No. 05-278884 cause feeding failure in the following manner as illustrated in FIGS. 11 and 12. When a recording medium P is fed into a separation nip formed between a separation roller 102 and a friction pad 103 by being pressed by a pick-up roller 101 to form a downwardly curved concave portion at the middle portion in the width direction, the leading end of the concave portion may hit the friction pad 103 to cause feeding failure. That is, the sheet feeders disclosed in Japanese Patent Application Laid-open No. 06-144619 and Japanese Patent Application Laid-open No. 05-278884 can prevent feeding failure arising from the contact between the edges of the recording medium P in the width direction and the friction pad 103 by using a guiding plate or a guiding member, but cannot prevent the collision between the leading end of the concave portion in the sheet feeding direction and the friction pad 103 and feeding failure that results.

Although a conventional sheet feeder in which a low friction sheet is provided to a friction pad can alleviate the resistance due to the collision by the action of the low friction sheet when the concave portion hits the friction pad as well, the number of components included in the sheet feeder increases due to the inclusion of the low friction sheet. Therefore, the increase in component cost and cost involved in component management and assembly has been unavoidable.

SUMMARY OF THE INVENTION

It is an object of the present invention to at least partially solve the problems in the conventional technology.

According to an aspect of the present invention, there is provided a sheet feeder including: a friction pad held by a pad holder; and a separation roller that is in contact with the friction pad while in rotation. A separation nip formed between the friction pad and the separation roller separates a recording medium from a plurality of recording media fed into the separation nip, and the pad holder includes a convex portion that is provided downstream of the friction pad in a sheet feeding direction and at a middle portion in a first width direction perpendicular to the sheet feeding direction and that is capable of coming into contact with the recording medium.

According to another aspect of the present invention, there is provided an image forming apparatus including the sheet feeder. The sheet feeder includes: a friction pad held by a pad holder; and a separation roller that is in contact with the friction pad while in rotation. A separation nip formed between the friction pad and the separation roller separates a recording medium from a plurality of recording media fed into the separation nip, and the pad holder includes a convex portion that is provided downstream of the friction pad in a sheet feeding direction and at a middle portion in a first width direction perpendicular to the sheet feeding direction and that is capable of coming into contact with the recording medium.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5A is a side view illustrating a low convex portion, and FIG. 5B is a side view illustrating a high convex portion;

FIG. 6A is a schematic illustrating a state where a concave portion is formed in a recording sheet, and FIG. 6B is a schematic illustrating a state where the concave portion of the recording sheet is removed by the convex portion;

DETAILED DESCRIPTION OF THE PREFERRED EMBODIMENTS

Embodiments of the present invention are described below with reference to the accompanying drawings.

First Embodiment

Figure 1:
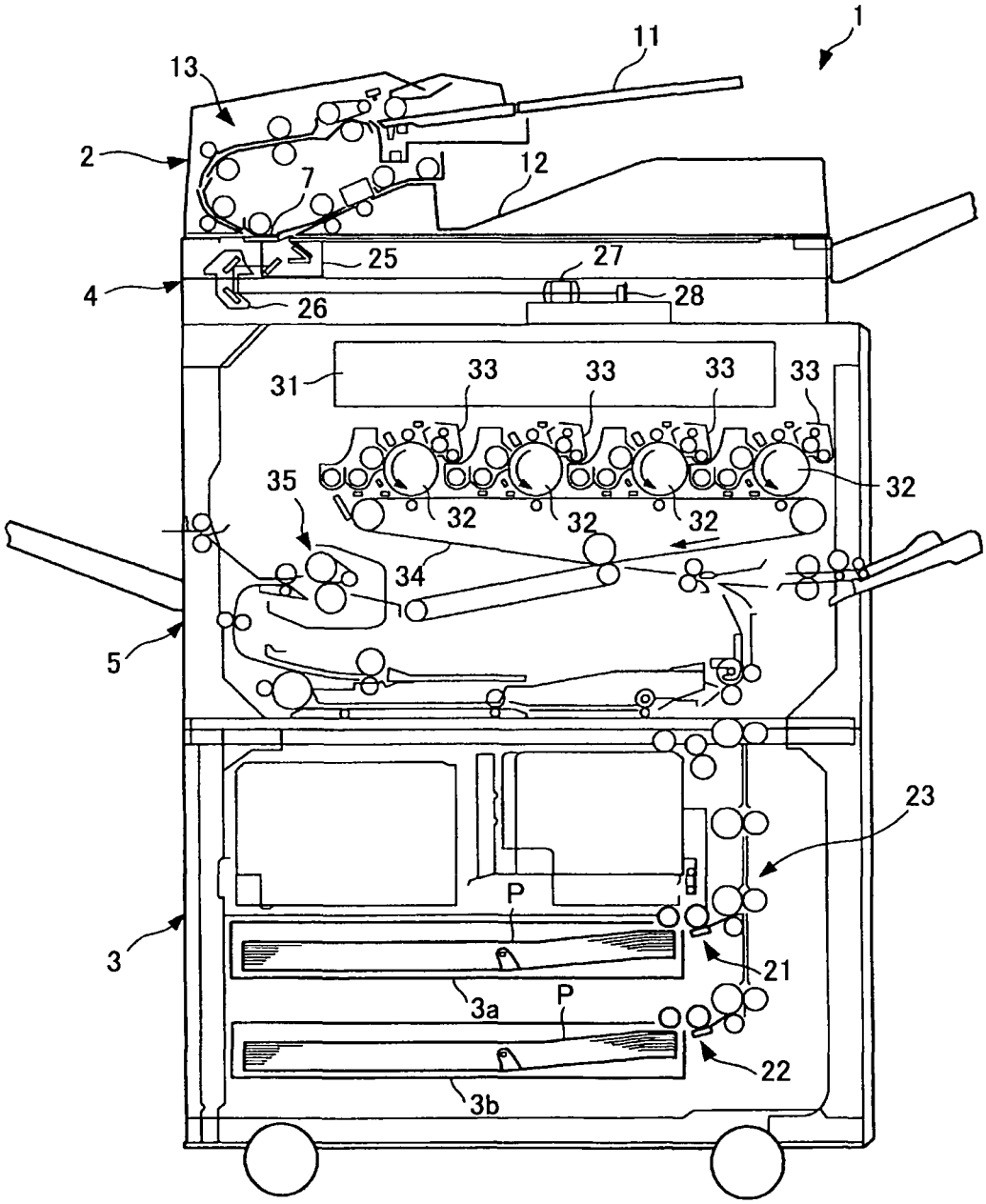
FIG. 1 is a schematic of an image forming apparatus according to a first embodiment of the present invention.

FIG. 1 is a schematic illustrating an embodiment of an image forming apparatus including a sheet feeder according to an embodiment of the present invention and illustrates an example in which the image forming apparatus is applied to a copying machine 1 that operates electro-photographically. Examples of the copying machine include a full-color copying machine forming images by a typical electrostatic image forming method and a copying machine forming monochrome images. Examples of available image formation systems include, besides electrophotography, inkjet systems, for example.

As illustrated in FIG. 1, the copying machine 1 includes an automatic document feeder (ADF) 2, a paper feeding unit 3, an image scanning unit 4, and an image forming unit 5.

The ADF 2 includes an original tray 11 as an original placing table and a conveying unit 13 including various rollers and other components. In the ADF 2, the conveying unit 13 conveys an original placed on the original tray 11 onto a slit glass 7 and makes the original scanned by the image scanning unit 4 through the slit glass 7 pass on the slit glass 7 to be discharged onto a discharge tray 12. The ADF 2 is provided to the image scanning unit 4 in an openable/closable manner via an open/close mechanism (not illustrated).

The paper feeding unit 3 includes paper cassettes 3*a* and 3*b* storing recording sheets having different sheet sizes, sheet feeders 21 and 22 feeding, after picking up therefrom, a recording sheet P as a recording medium stored in one of the paper cassettes 3*a* and 3*b*, and a conveying section 23 including various rollers that convey the recording sheet P fed from one of the sheet feeders 21 and 22 to the image forming position of the image forming unit 5.

The image scanning unit 4 includes a first carriage 25 on which a light source and a mirror member are mounted, a second carriage 26 on which a mirror member is mounted, an imaging lens 27, and an image capturing unit 28. In the image scanning unit 4, an original passing on the slit glass 7 is irradiated with light output from the light source mounted on the first carriage 25, the reflected light from the original is bent by each of the mirror members mounted on the first carriage 25 and the second carriage 26, and the reflected light is turned into an image by the imaging lens 27 and then is scanned by the image capturing unit 28.

The image forming unit 5 includes an exposing device 31, a photosensitive element 32, a developing unit 33, a transfer belt 34, and a fixing device 35. In the image forming unit 5, the exposing device 31 exposes the photosensitive elements 32 to form a latent image on the photosensitive element 32 based on an image scanned by the image capturing unit 28, and the developing unit 33 supplies the photosensitive element 32 with toner of each of a plurality of colors to perform development. Subsequently, in the image forming unit 5, the image developed on the photosensitive element 32 is transferred to the recording sheet P supplied from the paper feeding unit 3 by the transfer belt 34, and then, the fixing device 35 melts the toner of the toner image transferred onto the recording sheet P to fix a color image on the recording sheet P. Accordingly, a full-color image is formed on the recording sheet P.

The sheet feeder according to the present embodiment is described below using the sheet feeder 21 as an example with reference to FIGS. 2 and 3. The configuration of the sheet feeder 22 is similar to that of the sheet feeder 21, and thus, the description thereof is omitted.

Figure 2:
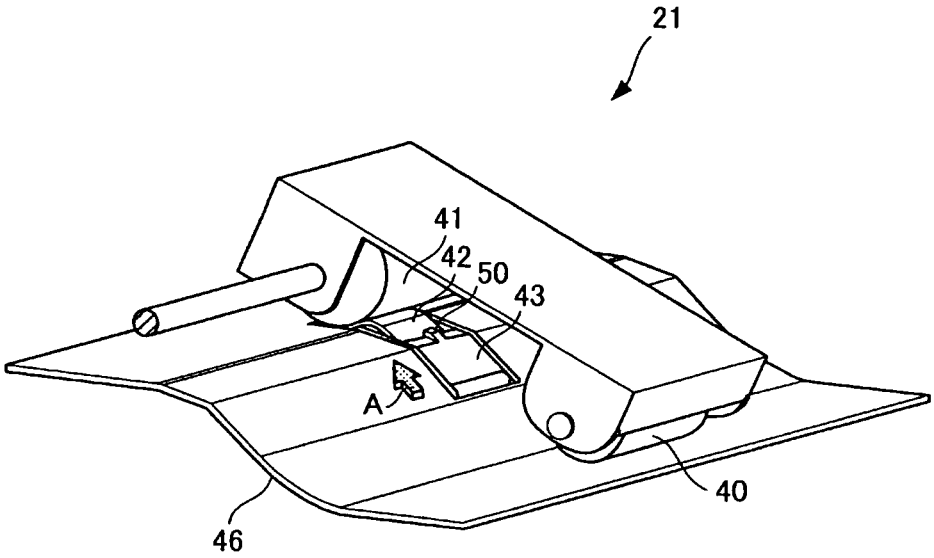
FIG. 2 is a perspective view of a sheet feeder according to the first embodiment of the present invention.
Figure 3:
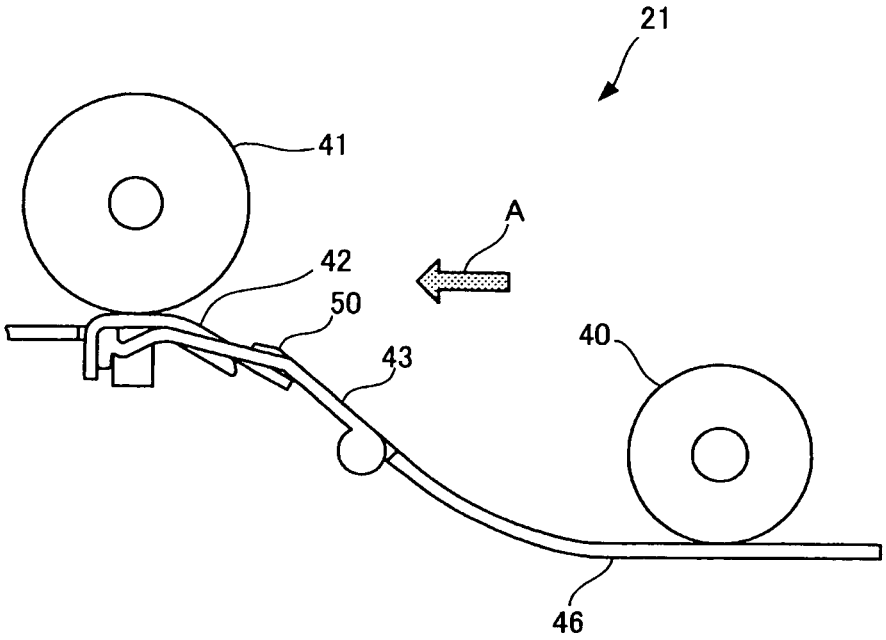
FIG. 3 is a side view of the sheet feeder according to the first embodiment of the present invention.

As illustrated in FIGS. 2 and 3, the sheet feeder 21 is the so-called friction pad separation type sheet feeder and includes a pick-up roller 40 as a paper feeding roller, a separation roller 41, a friction pad 42, and a pad holder 43.

The pick-up roller 40 feeds at least a recording sheet P at the top of a plurality of the recording sheets P stacked in the paper cassette 3*a* (see FIG. 1) into a separation nip to be described later.

The separation roller 41 is provided downstream of the pick-up roller 40 in the sheet feeding direction indicated by an arrow A in FIGS. 2 and 3 and is configured to rotate by being in contact with the friction pad 42 at a predetermined contact pressure.

The friction pad 42 is fixed on the pad holder 43 below the separation roller 41. The friction pad 42 is pressed against the separation roller 41 at a predetermined strength of pressure by pressing the pad holder 43 toward the separation roller 41 by a pressing unit such as a compression spring (not illustrated). Accordingly, the separation nip is formed between the separation roller 41 and the friction pad 42. The friction pad 42 like the above is formed of materials having a high coefficient of friction such as rubber, rubber cork, urethane foam, and thermoplastic elastomers.

When a coefficient of friction between the recording sheet P and the separation roller 41 is denoted by $\mu 1$, a coefficient of friction between the recording sheet P and the friction pad 42 is denoted by $\mu 2$, and a coefficient of friction between overlapping recording sheets is denoted by $\mu 3$, the coefficients of friction $\mu 1$, $\mu 2$, and $\mu 3$ are set so as to have a relation that $\mu 1 > \mu 2 > \mu 3$. Thus, the relations of the forces exerting among the separation roller 41, the friction pad 42, and the recording sheets at the separation nip is represented by the inequalities such that the conveying force for conveying the recording sheet P by the separation roller 41>the force to stop conveyance for stopping conveyance of the recording sheet P by the friction pad 42>frictional force exerting between recording sheets. Accordingly, for example, even when two of the overlapping recording sheets P are conveyed into the separation nip, the upper recording sheet P is conveyed because the force exerting on the upper recording sheet P is derived by the subtraction of the right hand side from the left hand side in the inequality that the conveying force by the separation roller 41>the frictional force between the recording sheets P. On the other hand, the force exerting on the lower recording sheet P is derived by the subtraction of the right hand side from the left hand side in the inequality that the force to stop conveyance by the friction pad 42>the frictional force between the recording sheets P (conveying force by the frictional force), and therefore, the lower recording sheet P is not conveyed. Even when one recording sheet P is fed into the separation nip, the one recording sheet P is properly conveyed because of the inequality stating that the conveying force by the separation roller 41>the force to stop conveyance by the friction pad 42.

The friction pad 42 is generally known to be worn by friction with the recording sheets P or the separation roller 41. For this reason, when the width of the friction pad 42 is larger than the width of the separation roller 41, the friction pad 42 becomes uneven due to friction between the friction pad 42 and the separation roller 41. The unevenness of the friction pad 42 adversely affects the separating performance of the recording sheet P by the sheet feeder, and thus, in the present embodiment, the width of the friction pad 42 is formed to be smaller than the width of the separation roller 41 so as not to cause the unevenness.

The pad holder 43 is provided in a path constitution member 46 forming a portion of the conveying path of the sheet feeder 21 and is pressed toward the separation roller 41 by a pressing unit (not illustrated). The pad holder 43 holds the friction pad 42 and includes a convex portion 50 on the top surface upstream of the friction pad 42 in the sheet feeding direction. The convex portion 50, lying upstream of the friction pad 42 in the sheet feeding direction, comes into contact with the recording sheets P before the friction pad 42. In addition, the convex portion 50 is arranged at the middle of the pad holder 43 in the width direction (the direction perpendicular to the sheet feeding direction). The convex portion 50 is arranged to be within the width of the pick-up roller 40 in the width direction in the positional relationship between the convex portion 50 and the pick-up roller 40. Preferably, the middle positions of the separation roller 41, the friction pad 42, the convex portion 50, and the pick-up roller 40 in respective width direction are desirably arranged to be in a line parallel to the sheet feeding direction. Accordingly, as described later, a concave portion formed in the recording sheet P can be easily removed by the convex portion 50.

Although a plurality of members can be provided for each of the pick-up roller 40, the separation roller 41, the friction pad 42, and the convex portion 50, from the viewpoint of cost, it is preferable that the sheet feeder 21 includes only one piece for each of the members listed above.

The convex portion 50 is described in detail below with reference to FIGS. 4, 5A, and 5B.

Figure 4:
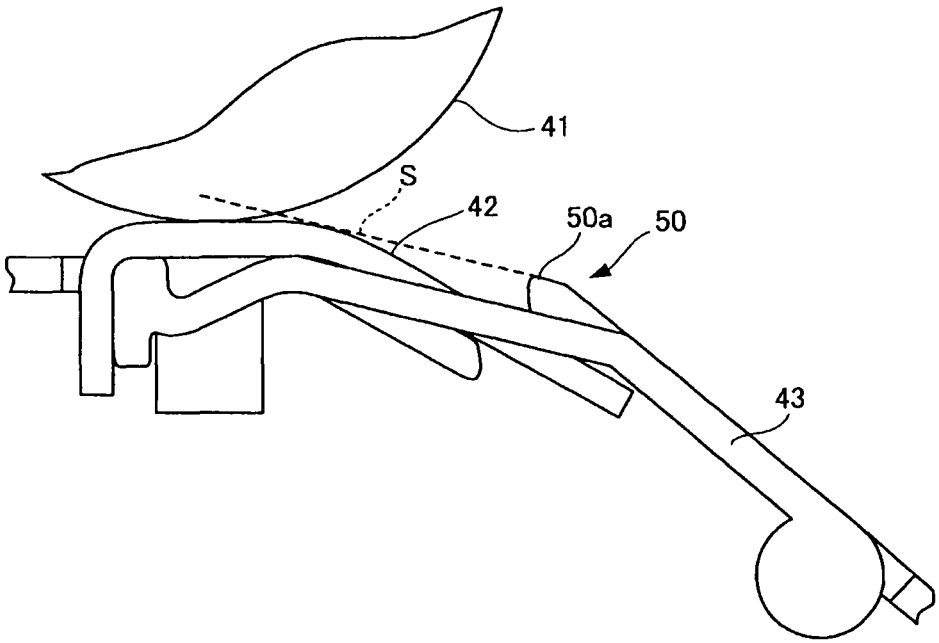
FIG. 4 is a side view of the sheet feeder according to the first embodiment of the present invention for describing the height of a convex portion.
Figure 5A:
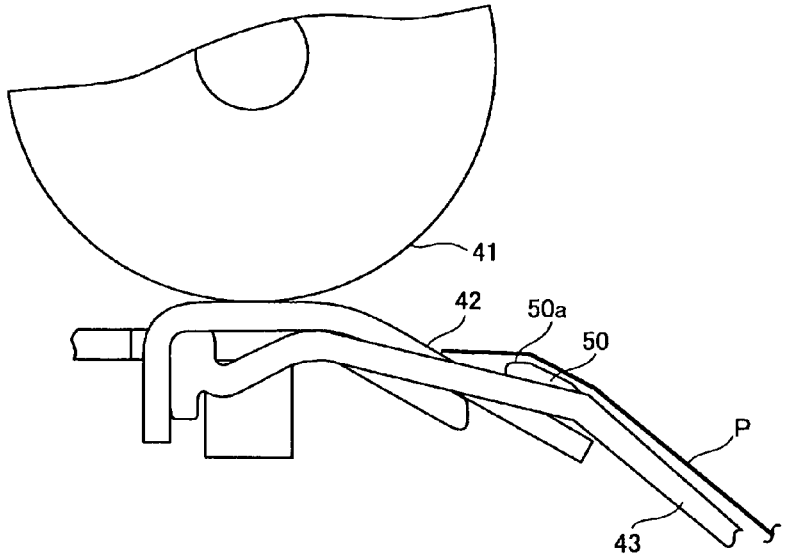
FIGS. 5A and 5B are schematics regarding the height of the convex portion.

As illustrated in FIG. 4, the convex portion 50 includes a flat surface portion 50*a*, on the top surface, to coming into contact with the recording sheet P. The height and the angle of the flat surface portion 50*a* are set so that an imaginary plane S that is parallel to the flat surface portion 50*a* and that extends from the flat surface portion 50*a* in the sheet feeding direction (see FIG. 3) comes into contact with at least the top surface of the friction pad 42 at the upstream side in the sheet feeding direction. The feeding failure of the recording sheet P can be prevented by setting the height and angle of the flat surface portion 50*a* as above. As illustrated in FIG. 5A, for example, when the height of the flat surface portion 50*a* is small or when the angle of the flat surface portion 50*a* is close to be horizontal as compared to the angle in FIG. 4, the leading end of the recording sheet P in the sheet feeding direction hits the friction pad 42 to be caught on to cause feeding failure. In contrast, as illustrated in FIG. 5B, for example, when the height of the flat surface portion 50*a* is large or when the angle of the flat surface portion 50*a* is inclined to be close to a vertical direction as compared to the angle in FIG. 4, the recording sheets P do not come into contact with the friction pad 42, and therefore, a plurality of the recording sheets P are fed into the separation nip without being subjected to pre-separation. As a result, proper separating performance may not be achieved. On the contrary, the flat surface portion 50*a* according to the present embodiment is set to have a proper height and angle with which failure as illustrated in FIGS. 5A and 5B is not caused.

The action of the sheet feeder 21 according to the present embodiment will be described below with reference to FIGS. 6A and 6B.

Figure 5B:
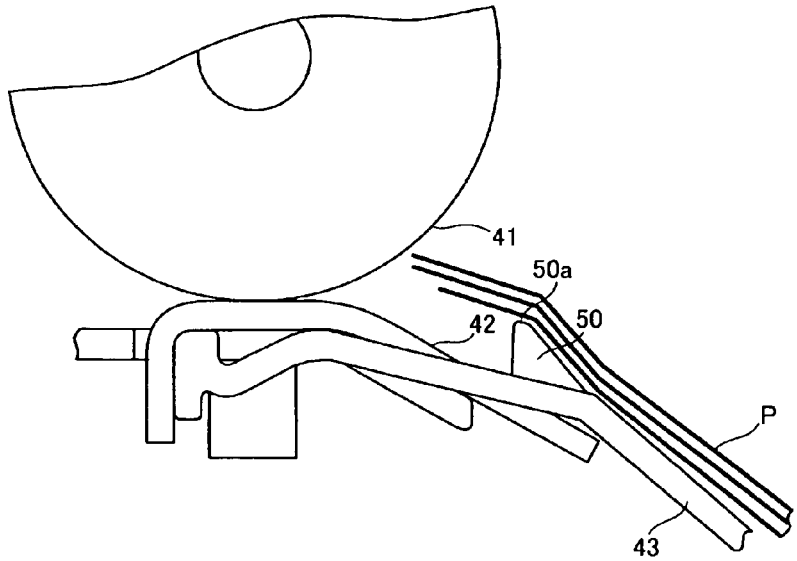
Figure 6A:
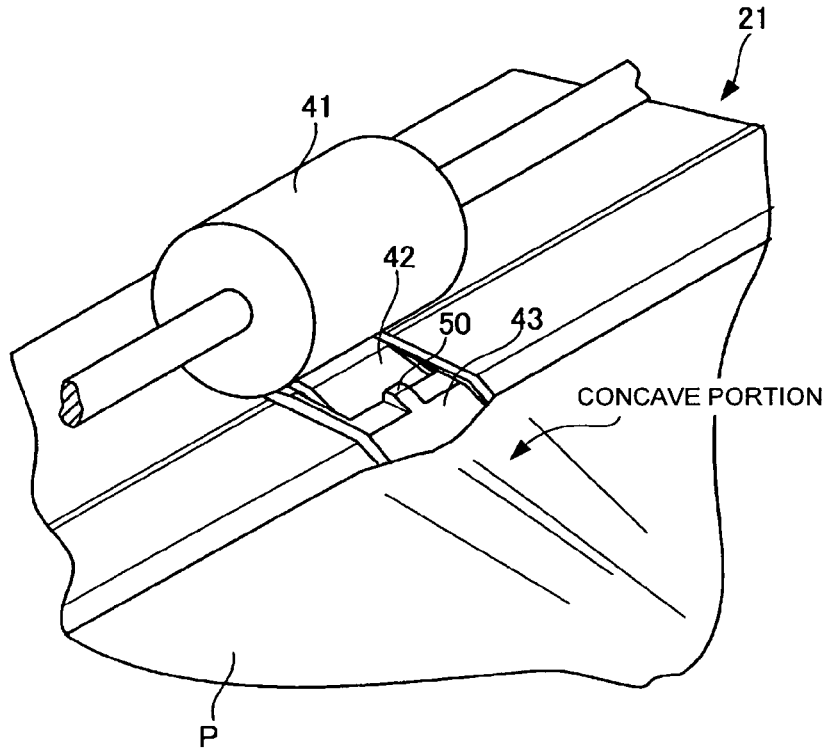
FIGS. 6A and 6B are schematics illustrating the action of the sheet feeder according to the first embodiment of the present invention.
Figure 6B:
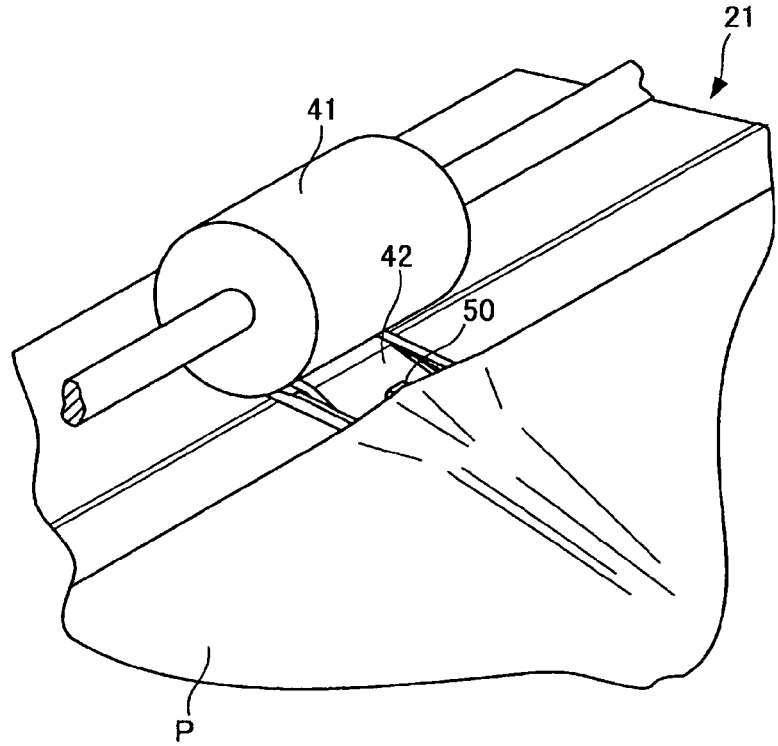

As illustrated in FIG. 6A, when the recording sheet P is fed into the separation nip by the pick-up roller 40 (see FIG. 2), a concave portion that is curved downwardly may be formed on the recording sheet P at the leading end in the sheet feeding direction and in the middle portion in the width direction by the pressing force of the pick-up roller 40 (or by the own weight). Conventionally, when the recording sheet P having the concave portion is to be fed into the separation nip, the leading end of the concave portion in the sheet feeding direction hits a friction pad to cause feeding failure. However, as illustrated in FIG. 5B, in the sheet feeder 21 according to the present embodiment, even when the recording sheet P having the concave portion is fed into the separation nip, the convex portion 50 provided in front of the friction pad 42 comes into contact with the concave portion of the recording sheet P, so that the concave portion can be removed. Accordingly, the concave portion of the recording sheet P does not hit the friction pad 42, and therefore, it is possible to avoid a case in which the recording sheet P is caught on by the friction pad 42 and fails to be fed.

As described above, in the sheet feeder 21 according to the present embodiment, the pad holder 43 includes the convex portion 50 that is provided downstream of the friction pad 42 in the sheet feeding direction and in the middle portion in the width direction and that can come into contact with the recording sheet P. Therefore, the leading end of the recording sheet P to be fed into the separation nip comes into contact with the convex portion 50 and is lifted in front of the friction pad 42. Thus, it is possible to prevent the occurrence of a collision between the leading end of the recording sheet P and the friction pad 42.

The sheet feeder 21 according to the present embodiment has a simple configuration in which the convex portion 50 is provided at the pad holder 43 and thus can avoid the collision of the recording sheet P with the friction pad 42. Therefore, there is no need to provide a low abrasion sheet such as a Mylar at a portion of a friction pad as in a conventional art. Accordingly, the feeding failure of the recording sheet P, during separation and feeding, can be prevented with a simple and low cost configuration without increasing the number of components.

In particular, in the sheet feeder 21 according to the present embodiment, because the convex portion 50 is provided within the width of the pick-up roller 40 in the width direction in the positional relationship between the convex portion 50 and the pick-up roller 40, even when the concave portion is formed in the recording sheet P as described above (see FIG. 5A), the concave portion is removed by being in contact with the convex portion 50 (see FIG. 5B). Accordingly, it is possible to avoid a collision of the leading end of the concave portion formed in the recording sheet P in the sheet feeding direction with the friction pad 42, and to prevent the feeding failure, during the separation and feeding, of the recording sheet P arising from the collision with the friction pad 42.

In the sheet feeder 21 according to the present embodiment, the positions of the flat surface portion 50*a* and the top surface of the friction pad 42 are set so that the imaginary plane S comes into contact with at least the top surface of the friction pad 42 in the upstream side in the sheet feeding direction. Thus, the surface of the recording sheet P to be fed into the separation nip comes into contact, face by face, with the top surface of the friction pad 42. This can reliably avoid the collision of the leading end of the recording sheet P in the sheet feeding direction with the friction pad 42.

Second Embodiment

A sheet feeder according to a second embodiment of the present invention will be described below with reference to FIGS. 7 and 8.

The sheet feeder according to the present embodiment and the sheet feeder according to the first embodiment are particularly different in the shape of the convex portion, but the other configurations are substantially the same. Therefore, the sheet feeder according to the present embodiment is described using the same numerals as in the first embodiment illustrated in FIGS. 1 to 6B, and the description is given below in details particularly on the difference between the two embodiments.

Figure 7:
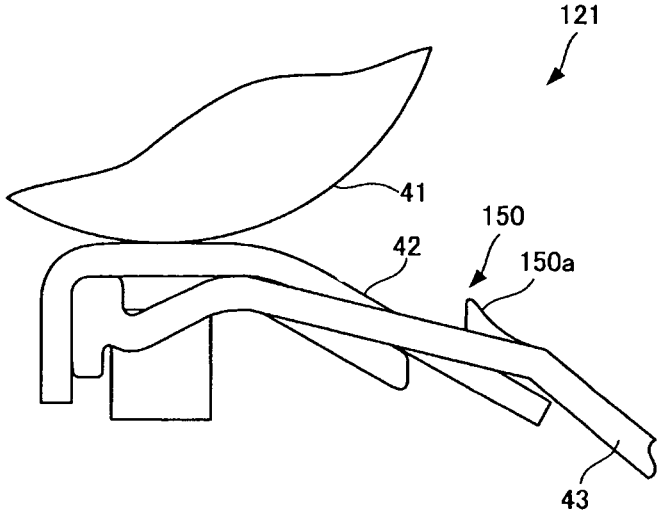
FIG. 7 is a partially enlarged side view of a sheet feeder according to a second embodiment of the present invention.
Figure 8:
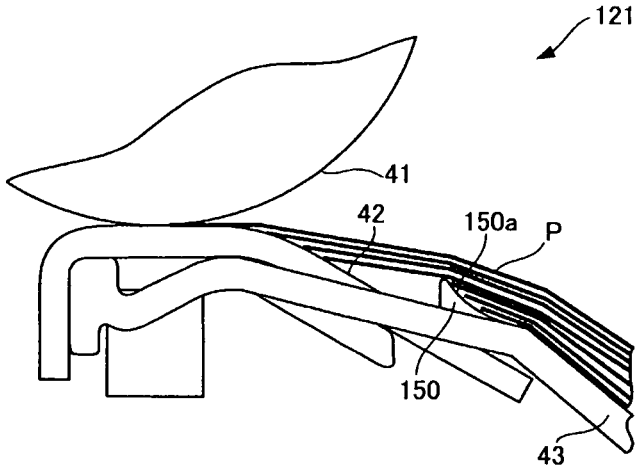
FIG. 8 is a partially enlarged side view for describing the action of the sheet feeder according to the second embodiment of the present invention.

As illustrated in FIG. 7, a convex portion 150 of a sheet feeder 121 according to the present embodiment is provided at the same position as the convex portion 50 according to the first embodiment and includes a contact surface portion 150*a* coming into contact with the recording sheet P to be fed into the separation nip.

The contact surface portion 150*a* is formed to be gradually upwardly inclined toward downstream in the sheet feeding direction (see FIG. 3) and to have a curved surface shape downwardly concave in the sheet feeding direction. Because of this configuration, as illustrated in FIG. 8, the leading end of a stack of a plurality of the recording sheets P in the sheet feeding direction abut the curved contact surface portion 150*a* during feeding and are subjected to the so-called pre-separation by which the sheets are separated one by one.

As described above, the sheet feeder 121 according to the present embodiment performs pre-separation before being fed into the separation nip in addition to the effects obtained in the first embodiment, thereby to improve the separation performance of the separation nip on the recording sheets P.

Figure 9:
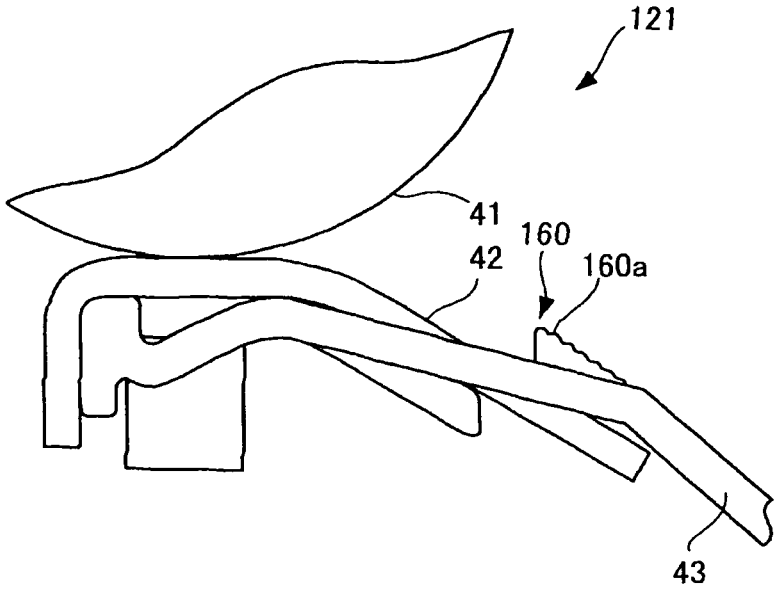
FIG. 9 is a side view illustrating a modified example of a convex portion according to the second embodiment of the present invention.
Figure 10:
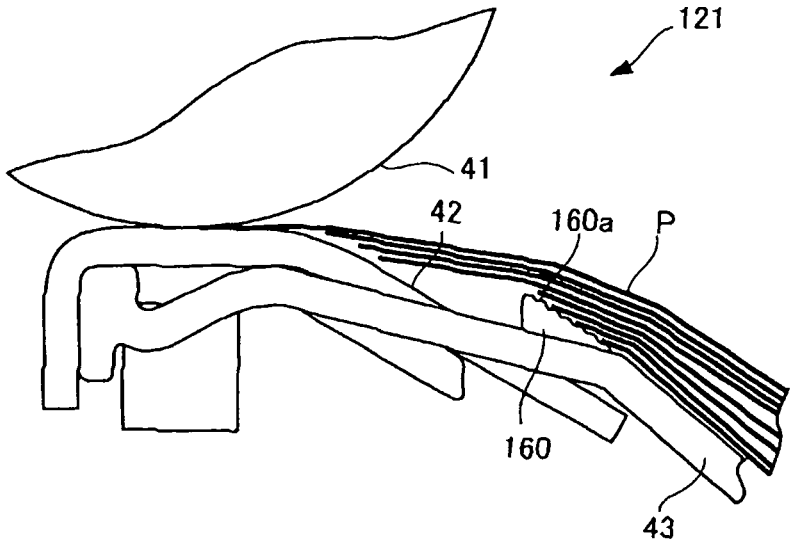
FIG. 10 is a side view describing the action of the convex portion illustrated in FIG. 9.
Figure 11:
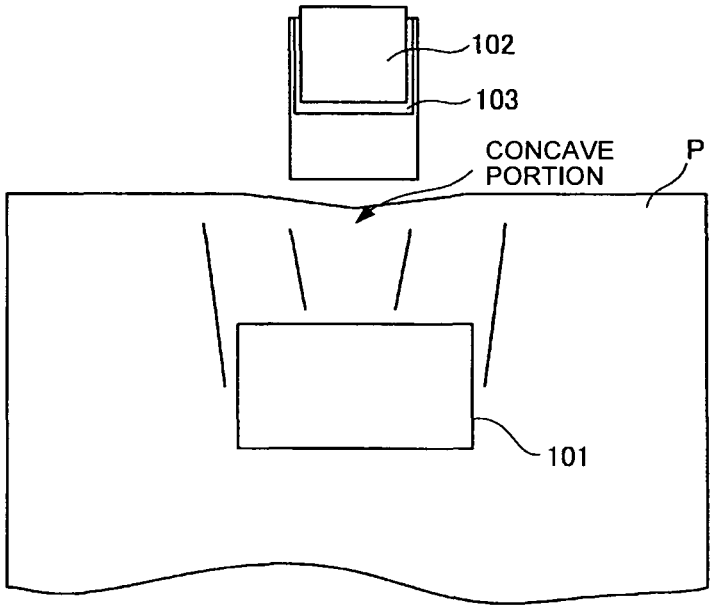
FIG. 11 is a top view of a sheet feeder having a conventional structure.
Figure 12:
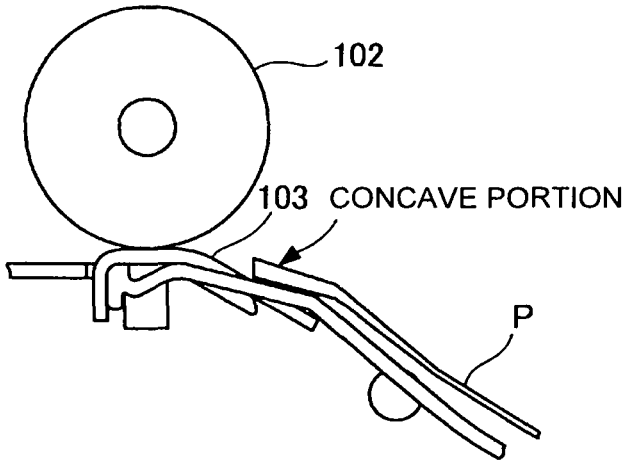
FIG. 12 is a side view of the sheet feeder having the conventional structure illustrated in FIG. 11.

In the present embodiment, the convex portion 150 includes the contact surface portion 150*a* formed to have a curved surface, but the configuration is not limited thereto. For example, as illustrated in FIG. 9, a convex portion 160 including an inclined surface portion 160*a* may also be formed. Specifically, the inclined surface portion 160*a* is gradually upwardly inclined toward downstream in the sheet feeding direction, similarly to the contact surface portion 150*a* as described above, and comes into contact with the recording sheets P. Instead of a curved surface, the inclined surface portion 160*a* is formed to have staircase-like steps running parallel to the width direction. Because of this structure, as illustrated in FIG. 10, the leading end of a stack of the recording sheets P in the sheet feeding direction abut the staircase-like steps of the inclined surface portion 160*a* to allow the so-called pre-separation by which the sheets are separated one by one without being fed into the separation nip at once. Accordingly, the sheet feeder 121 having the convex portion 160 performs pre-separation before being fed into the separation nip by the staircase-like inclined surface portion 160*a* in addition to the effects obtained in the first embodiment, thereby to improve the separation performance of the separation nip on the recording sheets P.

In each of the embodiments described above, examples are described in which the sheet feeder according to an aspect of the present invention is applied to the sheet feeder 21 provided in the paper feeding unit 3 of the copying machine 1. However, the sheet feeder according to an aspect of the present invention is also applicable to any friction pad assembly sheet feeder and, is applicable to, for example, a sheet feeder for a bypass tray and other devices.

The present invention can provide the sheet feeder that can prevent feeding failure of recording medium during separation and feeding with a simple and low cost configuration without increasing the number of components and an image forming apparatus including the sheet feeder.

With the configurations described above, the present invention can provide the image forming apparatus including the sheet feeder that can prevent feeding failure of recording medium during separation and feeding with a simple and low cost configuration without increasing the number of components.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeder, comprising:

a friction pad held by a pad holder; and a separation roller that is in contact with the friction pad while in rotation, wherein a separation nip formed between the friction pad and the separation roller separates a recording medium from a plurality of recording media fed into the separation nip, and the pad holder includes a convex portion that is provided upstream of the friction pad in a sheet feeding direction and at most a middle portion of the pad holder in a first width direction perpendicular to the sheet feeding direction, and the recording medium comes into contact with the convex portion prior to the friction pad.

2. The sheet feeder according to claim 1, further comprising a paper feeding roller that is provided upstream of the convex portion in the sheet feeding direction and that feeds at least a recording medium at a top of a stack of a plurality of the recording media into the separation nip, wherein an arrangement position of the convex portion in the first width direction in positional relationship with the paper feeding roller is within a width of the paper feeding roller in a second width direction.

3. The sheet feeder according to claim 1, wherein the convex portion includes a flat surface portion that is in contact with the recording medium at a top surface of the convex portion, and positions of the flat surface portion and an top surface of the friction pad are set so that an imaginary plane that is parallel to the flat surface portion and that extends from the flat surface portion in the sheet feeding direction is in contact with at least the top surface of the friction pad at an upstream side in the sheet feeding direction.

4. The sheet feeder according to claim 1, wherein the convex portion includes a contact surface portion that is in contact with the recording medium, and the contact surface portion is formed to be gradually upwardly inclined toward downstream in the sheet feeding direction and to have a curved surface shape downwardly concave in the sheet feeding direction.

5. The sheet feeder according to claim 1, wherein the convex portion includes an inclined surface portion that is gradually upwardly inclined toward downstream in the sheet feeding direction and that is in contact with the recording medium, and the inclined surface portion has staircase-like steps parallel to the first width direction.

6. The sheet feeder according to claim 1, wherein when a coefficient of friction between the recording medium and the separation roller is denoted by $\mu 1$, a coefficient of friction between the recording medium and the friction pad is denoted by $\mu 2$, and a coefficient of friction between overlapping recording media is denoted by $\mu 3$, the coefficients of friction $\mu 1$, $\mu 2$, and $\mu 3$ are set so as to have a relationship $\mu 1 > \mu 2 > \mu 3$.

7. An image forming apparatus comprising the sheet feeder that includes:

a friction pad held by a pad holder; and a separation roller that is in contact with the friction pad while in rotation, wherein a separation nip formed between the friction pad and the separation roller separates a recording medium from a plurality of recording media fed into the separation nip, and the pad holder includes a convex portion that is provided upstream of the friction pad in a sheet feeding direction and at most a middle portion of the pad holder in a first width direction perpendicular to the sheet feeding direction, and the recording medium comes into contact with the convex portion prior to the friction pad.

* * * * *